US005570724A

United States Patent [19]

Bassi et al.

[11] Patent Number: 5,570,724

[45] Date of Patent: Nov. 5, 1996

[54] MECHANISM FOR CONTROLLING THE RECIPROCATING MOVEMENT OF GRIFFE FRAMES WITH CONNECTION ROD/CRANK SYSTEM

[75] Inventors: Dario Bassi, Chaponnay; Damien Bouchet, Decines, both of France

[73] Assignee: Staubli Lyon, Chassieu, France

[21] Appl. No.: 426,841

[22] Filed: Apr. 24, 1995

[30] Foreign Application Priority Data

May 5, 1994 [FR] France ..... 94 05768

[51] Int. Cl.[6] ..... D03C 3/36

[52] U.S. Cl. ..... 139/59; 74/47

[58] Field of Search ..... 139/59, 68, 65, 139/1 R; 74/25, 54, 47

[56] References Cited

U.S. PATENT DOCUMENTS

| | | | |
|---|---|---|---|
| 5,103,873 | 4/1992 | Bassi | 139/68 X |
| 5,115,838 | 5/1992 | Derudder . | |
| 5,176,181 | 1/1993 | Bassi | 139/59 |

FOREIGN PATENT DOCUMENTS

| | | | |
|---|---|---|---|
| 605701 | 11/1925 | France . | |
| 1389303 | 4/1964 | France . | |
| 1473435 | 3/1966 | France . | |
| 899929 | 11/1953 | Germany | 139/59 |
| 1535220 | 12/1970 | Germany | 139/59 |
| 4027575C1 | 2/1992 | Germany . | |
| 433139 | 9/1967 | Switzerland | 139/59 |
| 986770 | 3/1965 | United Kingdom | 139/59 |
| 1032014 | 6/1966 | United Kingdom | 139/59 |
| 2047755 | 3/1983 | United Kingdom | 139/59 |

*Primary Examiner*—Andy Falik
*Attorney, Agent, or Firm*—Dowell & Dowell

[57] ABSTRACT

A mechanism for controlling the reciprocating movement of griffe frames in a weaving loom which includes four crank arms which are mounted offset angularly with respect to one another to a driving shaft associated with the loom. Two short connecting rods and two long connecting rods are connected to the four crank arms with the two short connecting rods being pivotally mounted to one of the griffe frames and the two long connecting rods being mounted to the other of the griffe frames whereby rotation of the driving shaft causes a reciprocating movement of the griffe frames.

12 Claims, 2 Drawing Sheets

MECHANISM FOR CONTROLLING THE RECIPROCATING MOVEMENT OF GRIFFE FRAMES WITH CONNECTION ROD/CRANK SYSTEM

BACKGROUND OF THE INVENTION

1. Field of the Invention

The present invention relates to mechanisms for controlling the reciprocating movement of griffe frames of a weaving system.

2. History of the Related Art

Mechanisms of the type in question are known to exist, which include sets of complementary cams fitted on the two ends, projecting beyond the chassis of the system, of a shaft which traverses the chassis. Each cam cooperates with a follower roller mounted on a rocking lever which is joined with connecting rods connected to the two griffe frames. Such a mechanism has been described for example in Applicants' FR-A-94.03026 filed on 10th Mar. 1994.

Such a mechanism, which may be placed at the bottom or at the top of the chassis, creates considerable forces between the periphery of the cams and the follower rollers, with the result that it is absolutely necessary to provide considerable lubrication. An excellent solution consists in placing the cams in a bath of oil. However, this involves the presence of oil pans, seals, etc . . . , resulting in the assembly being relatively complex and consequently expensive.

It is an object of the improvements forming the subject matter of the present invention to overcome these drawbacks and to enable connections to be made between the control shaft of the system and the connecting rods associated with the griffe frames, which necessitate only limited lubrication.

SUMMARY OF THE INVENTION

To that end, on each end of the shaft which projects beyond the chassis, there are fitted four crank arms offset angularly and which have crank pins located at a certain distance from the geometrical axis of the shaft. Two short connecting rods and two long connecting rods are articulated on the crank pins and on the lower and upper griffe frames, respectively.

Under these conditions, the connecting rods may be articulated on the crank pins by means of sealed ball bearings which do not require lubrication and may consequently work in the open air.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
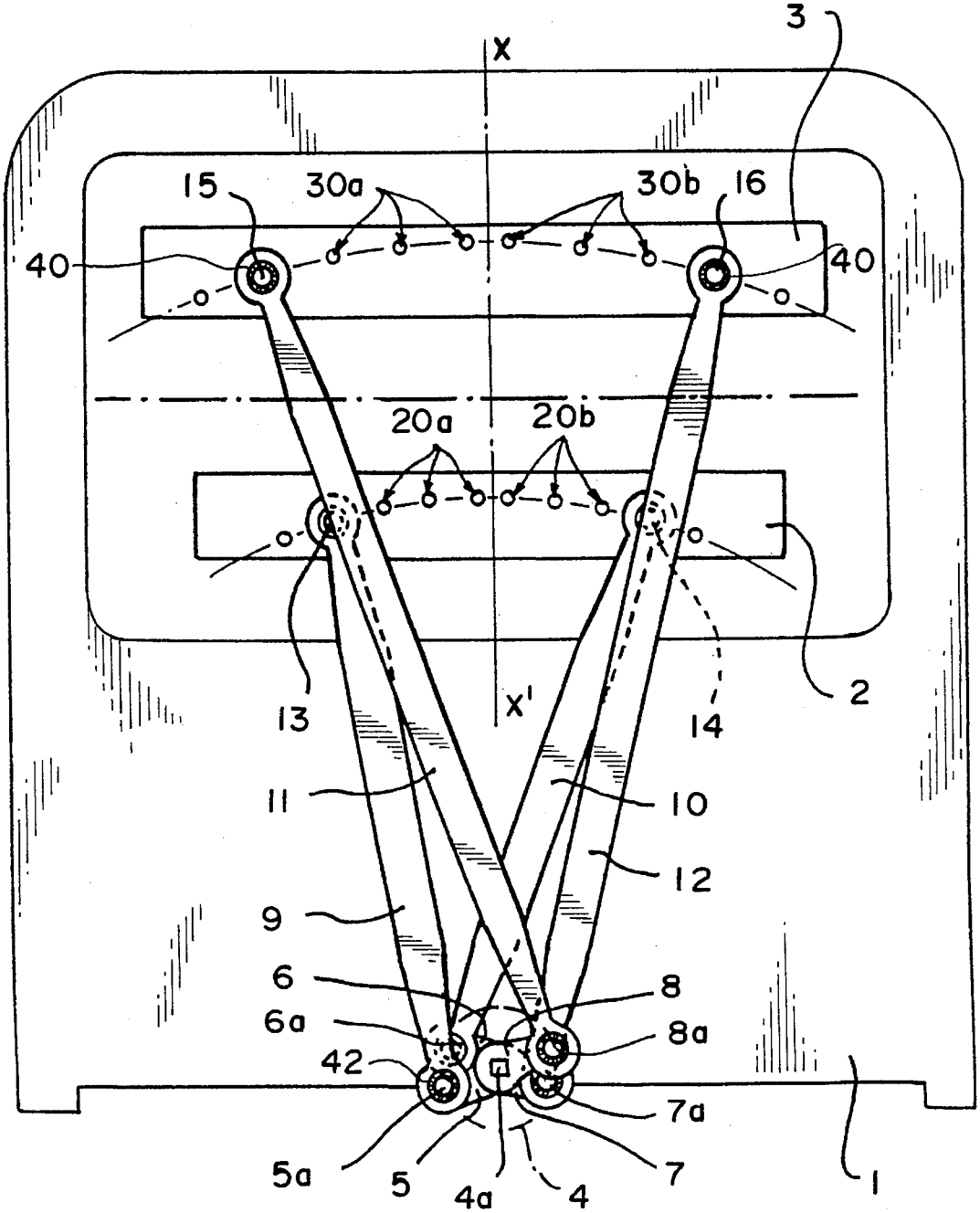
FIG. 1 shows a schematic side view of one of the ends of the shaft controlling a weaving system comprising a mechanism for controlling the reciprocating movement of the griffe frames according to the invention.

Referring now to the drawings, the Figures show the frame 1 of a weaving system comprising two griffe frames. The lower griffe frame has been referenced 2 and the upper griffe frame 3.

Figure 2:
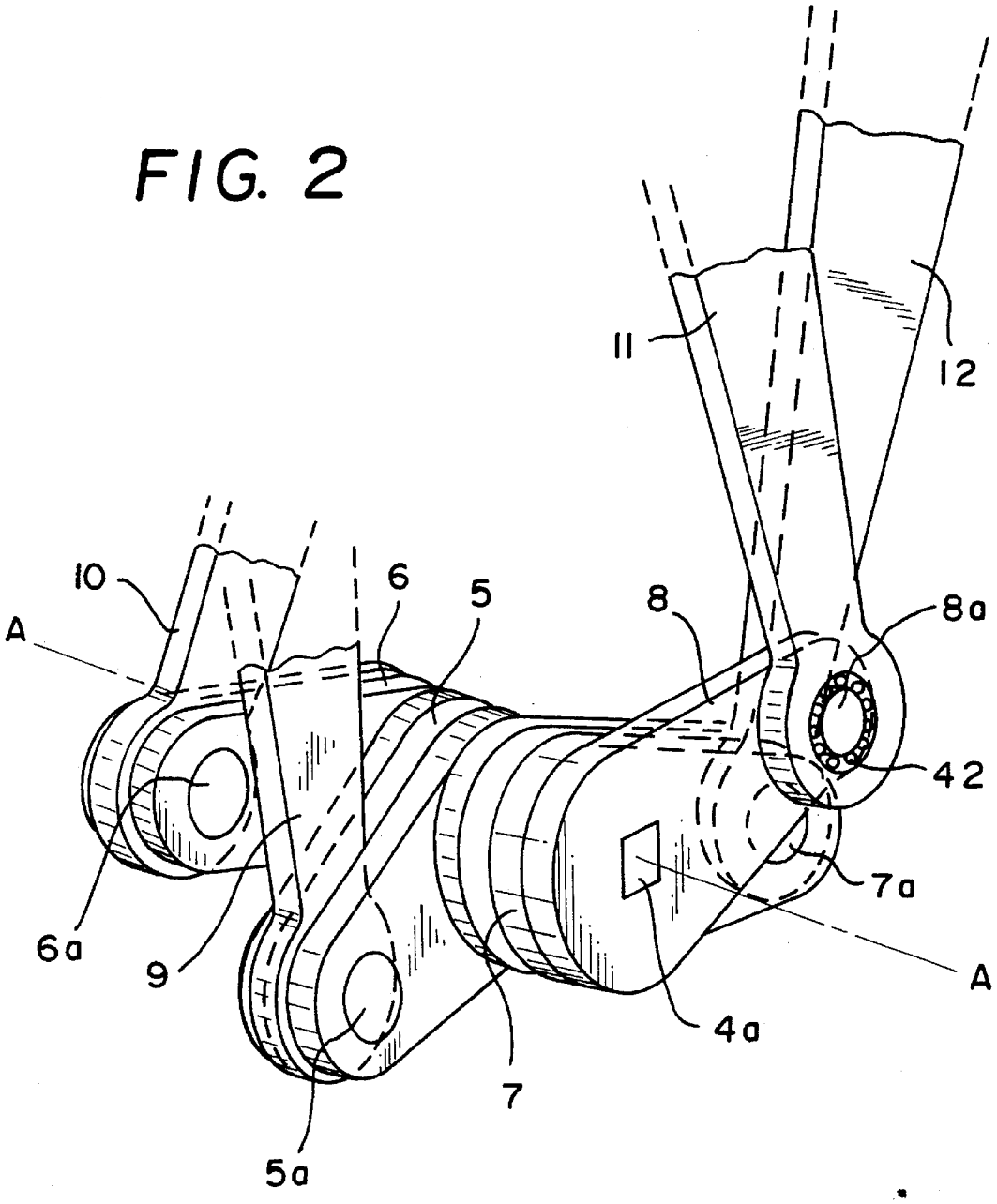
FIG. 2 is a perspective view of the end of the driving shaft showing the crank arms and lower ends of the connecting rods shown in FIG. 1.

On each end 4*a* of the driving shaft 4 for controlling the mechanism, which is conventionally driven by the driving shaft of the corresponding weaving loom, there have been fitted four crank arms 5, 6, 7 and 8 of the same length, each comprising at their free or outer end a crank pin 5*a*, 6*a*, 7*a*, 8*a*. Of course, if the four crank arms 5, 6, 7 and 8 are of the same length, a levelled shed is obtained. An oblique shed is generally sought after, and under these conditions, the arms 5, 6, 7 and 8 are of different lengths, adapted to the desired mean obliquities. The crank arms 5–8 are appropriately offset angularly so that the crank pins located on one side, of the elongated axis A—A of the shaft, as shown in FIG. 2 i.e. crank pins 5*a* and 6*a*, are associated with one of the ends of short connecting rods 9, 10 of which the other ends are articulated on the lower griffe frame 2. Similarly, crank pins 7*a* and 8*a*, opposite 5*a*, 6*a*, are articulated on one of the ends of the long connecting rods 11, 12 of which the opposite ends are articulated on the upper griffe frame 3.

The four connecting rods are articulated on the two frames via a pin mounted to rotate in ball bearings 40 associated with the corresponding ends of said connecting rods. The pins of connecting rods 9, 10 are referenced 13, 14, while those of connecting rods 11, 12 are referenced 15 and 16.

In accordance with the invention, the two griffe frames 2, 3 each comprise on their two opposite ends two series of holes 20*a*, 20*b* and 30*a*, 30*b*, respectively, distributed over a circumference whose radius is equal to the length of the connecting rods 9, 10 and 11, 12, respectively. It will be observed that the two series of holes of each griffe frame are disposed on either side of the median axis X, X' of the frame in question.

In the illustration shown in the FIG. 1, pins 13, 14 and 15, 16, respectively, are engaged in holes in the two griffe frames, chosen so that the latter move in a reprocating motion parallel to one another to make a levelled shed. If it is desired to make an oblique shed, it suffices to change the position of the pins in the series of holes in the griffe frames so that they take the oblique position chosen, allowing the desired oblique shed to be made.

Both the crank pins of crank arms 5–8 and pins 13–16 are articulated on connecting rods 9–12 by means of sealed ball bearings or the like 42, with the result that the assembly is simple, economical and easy to maintain, therefore inexpensive. In addition, the adjustments which exist on the known mechanisms for controlling the griffe frames at the cams and follower rollers and which are complex to make, are, according to the present invention, quite simply transferred to the griffe frames, hence they are particularly easy to make.

It must, moreover, be understood that the foregoing description has been given only by way of example and that it in no way limits the domain of the invention which would not be exceeded by replacing the details of execution described by any other equivalents.

What is claimed is:

1. In a weaving loom having a chassis and a driving shaft having an elongated axis and outer end portions extending from the chassis, a mechanism mounted to each end portion of the driving shaft for controlling the reciprocating movement of upper and lower griffe frames of a shed-forming device, wherein each mechanism comprises:

four crank arms mounted to the driving shaft and angularly offset relative to one another and with respect to the elongated axis of the driving shaft, each crank arm having a crank pin located at a predetermined distance from the elongated axis of the driving shaft, two short connecting rods each having first and second ends, means for pivotally connecting said first ends of said two short connecting rods to said crank pins of a first two of said crank arms, respectively, two long connecting rods each having first and second ends, means for pivotally connecting said first end of said two long connecting rods to said crank pins of a second two of said crank arms, respectively, means for pivotally connecting said second ends of said short connecting rods to one of said upper and lower griffe frames and means for pivotally connecting said second ends of said long connecting rods to the other of said upper and lower griffe frames, whereby said upper and lower griffe frames are reciprocated by said two short and two long connecting rods as said crank arms are driven by the driving shaft.

2. The mechanism of claim 1 in which said means for pivotally connecting said first and second ends of each of said short and long connecting rods include ball bearings.

3. The mechanism of claim 1 in which said predetermined distance of each of said crank pins from the elongated axis of the driving shaft is of the same length.

4. The mechanism of claim 1 wherein said predetermined distance of each of said crank pins from the elongated axis of the driving shaft is of a different length.

5. The mechanism of claim 1 in which said two short connecting rods are disposed in angular relationship on one side of the elongated axis of the driving shaft relative to the two long connecting rods which are oriented in angular relationship with respect to one another on an opposite side of the elongated axis of the driving shaft.

6. The mechanism of claim 1 wherein said means for pivotally connecting said first and second ends of each of said short and long connecting rods includes two series of openings in each of said upper and lower griffe frames, each of said second ends of said two long and two short connecting rods including pin means, said pin means of one of said short connecting rods being connected within a first of said two series of openings in said one of said griffe frames and said pin means of said other of said short connecting rods being receivable within one of said openings of a second of said two series of openings in said one of said griffe frames, said pin means of one of said two long connecting rods being receivable within one of said openings of a first of said two series of openings in the other of said upper and lower griffe frames and the pin means of the other of said long connecting rods being selectively receivable within one of the openings in a second of the two series of openings in the other of said upper and lower griffe frames, whereby, the relative positioning of the pin means of said short and long connecting rods with respect to said first and second series of openings in said upper and lower griffe frames determines the reciprocating movement of said griffe frames.

7. The mechanism of claim 6 wherein each of said upper and lower griffe frames are positioned so as to extend on opposite sides of a median axis through said chassis, said first series of openings in each of said upper and lower griffe frames being positioned on one side of said median axis and said second series of openings of said upper and lower griffe frames being positioned on the opposite side of said median axis.

8. The mechanism of claim 7 in which said first and second series of openings in each of said griffe frames are disposed along separate arcs each defined having a radius substantially equal to the length of the short and long connecting rods connected thereto, respectively, which are connected to said griffe frames.

9. A shed-forming device for a weaving loom having a chassis and a driving shaft having an elongated axis and opposite outer portions extending from the chassis, the shed-forming device comprising:

upper and lower griffe frames, each of said upper and lower griffe frames having opposite ends, each of said opposite ends of each of said upper and lower griffe frames including a first and second series of openings therein, a set of four crank arms mounted to each of the opposite outer portions of the driving shaft, respectively, said four crank arms of each set being angularly offset relative to one another and with respect to the elongated axis of the driving shaft, each crank arm having a crank pin located at a predetermined distance from the elongated axis of the driving shaft, a set of connecting rod means for connecting each set of crank arms to said opposite ends of said upper and lower griffe frames, each set of said connecting rod means including two short connecting rods each having first and second ends, means for pivotally connecting said first ends of said two short connecting rods to said crank pins of a first two of one of said sets of crank arms, respectively, two long connecting rods each having first and second ends, means for pivotally connecting said first end of said two long connecting rods to said crank pins of a second two of said one of said sets of crank arms, respectively, means for pivotally connecting said second end of a first of said two short connecting rods to the first series of openings in one of said ends of one of said upper and lower griffe frames, means for pivotally connecting said second end of the other of said two short connecting rods to the second series of openings in said one of said ends of said one of said upper and lower griffe frames, means for pivotally connecting said second end of a first of said two long connecting rods to one of said of first series of openings in said one of said ends of the other of said upper and lower griffe frames, means for pivotally connecting said second end of a second of said two long connecting rods to one of the second series of openings in said one of said ends of the other of said upper and lower griffe frames, whereby said upper and lower griffe frames are reciprocated by said sets of two short and two long connecting rods as each of said sets of said crank arms are driven by the driving shaft.

10. The shed-forming device of claim 9 in which said first and second series of openings of said one of said upper and lower griffe frames being spaced along separate arcs defined by a radius having a length substantially equal to a length of one of said short connecting rods, and said first and second series of openings in said other of said upper and lower griffe frames being spaced along separate arcs defined by a radius having a length substantially equal to the length of one of said long connecting rods.

11. The shed-forming device of claim 10 wherein said predetermined distance of each of said crank pins from the elongated driving axis is of the same length.

12. The shed-forming device of claim 10 wherein said predetermined distance of each of said crank pin from the elongated driving axis is of a different length.

* * * * *